US005620397A

United States Patent [19]

Chieh

[11] Patent Number: 5,620,397

[45] Date of Patent: Apr. 15, 1997

[54] MULTIPURPOSE EXERCISE DEVICE

[76] Inventor: Huang-Chun Chieh, P.O. Box 453, Taichung, Taiwan

[21] Appl. No.: 580,805

[22] Filed: Dec. 29, 1995

[51] Int. Cl.[6] ..... A63B 21/02; A63B 23/14; A63B 5/22

[52] U.S. Cl. ..... 482/46; 482/82; 482/121; 482/126

[58] Field of Search ..... 482/44, 45, 46, 482/50, 82, 106, 107, 108, 121, 122, 126

[56] References Cited

U.S. PATENT DOCUMENTS 3,396,967 8/1968 Brown ..... 482/46
4,695,049 9/1987 Ciemiega ..... 482/46
4,722,523 2/1988 Yang ..... 482/126
4,733,861 3/1988 Plunkett, III ..... 482/82

*Primary Examiner*—Lynne A. Reichard

[57] ABSTRACT

A multipurpose exercise device comprises a dumb bell set, a spring, a resilient tube set, a jump rope, and a plurality of pivoting apparatuses. The component parts of the multipurpose exercise device are so assembled that the exercise device can be used interchangeably as an arm building device, a chest building device, or a jump rope.

1 Claim, 9 Drawing Sheets

MULTIPURPOSE EXERCISE DEVICE

FIELD OF THE INVENTION

The present invention relates generally to an exercise device, and more particularly to a multipurpose exercise device that can be used as an arm building device, a chest building device, or a jump rope.

BACKGROUND OF THE INVENTION

The conventional exercise devices are generally designed for use in doing only one specific kind of exercise. As a result, the consumers must purchase a variety of exercise devices for doing different body-building exercises. This means that the consumers have to spend additionally a substantial amount of money on the exercise devices, and that the consumers must provide additional space for keeping the exercise devices.

SUMMARY OF THE INVENTION

It is therefore the primary objective of the present invention to provide a multipurpose exercise device, which comprises the component parts such as a dumb bell set, a spring, a resilient tube set, a jump rope, and a plurality of pivoting apparatuses. The component parts of the exercise device of the present invention are so assembled and combined that the exercise device can be used as an arm building device, a chest building device, or a jump rope.

The foregoing objective, features and functions of the present invention will be more readily understood upon a thoughtful deliberation of the following detailed description of the present invention in conjunction with the accompanying drawings.

DETAILED DESCRIPTION OF THE INVENTION

Figure 1:
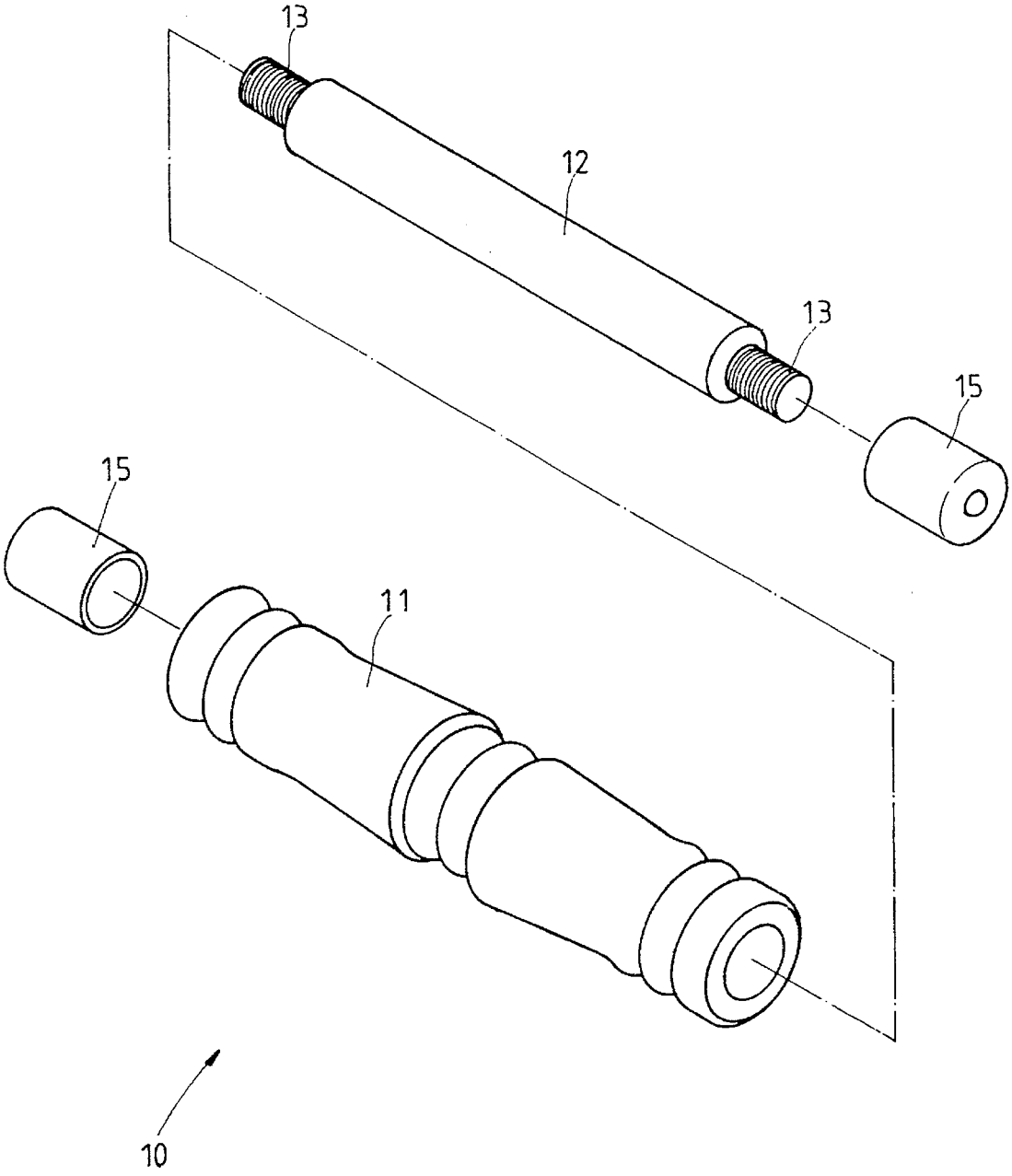
FIG. 1 shows an exploded view of the dumb bell set of the present invention.
Figure 2:
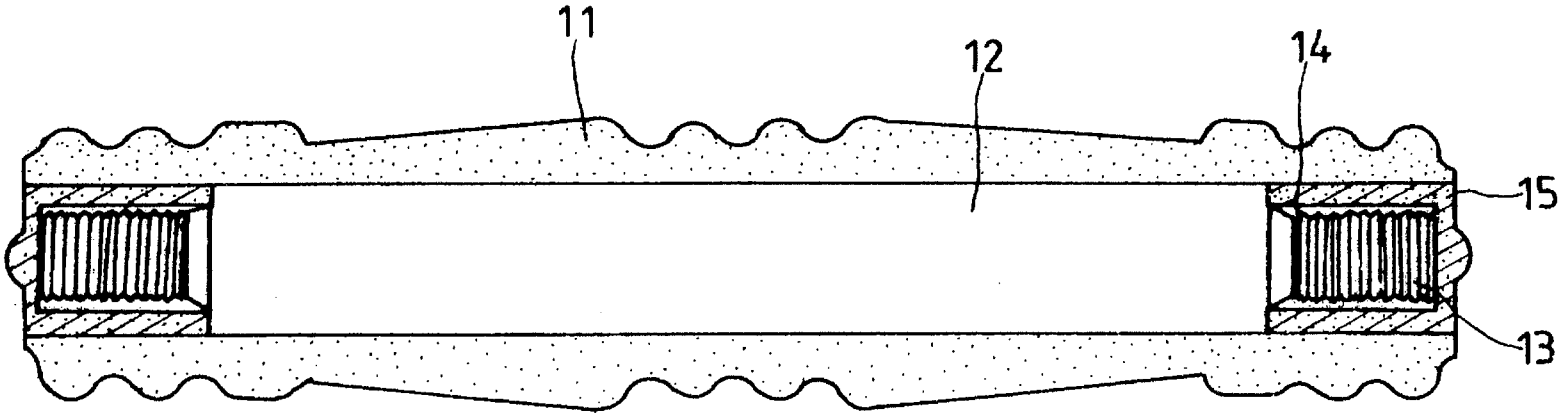
FIG. 2 shows a sectional view of the dumb bell set in combination according to the present invention.
Figure 3:
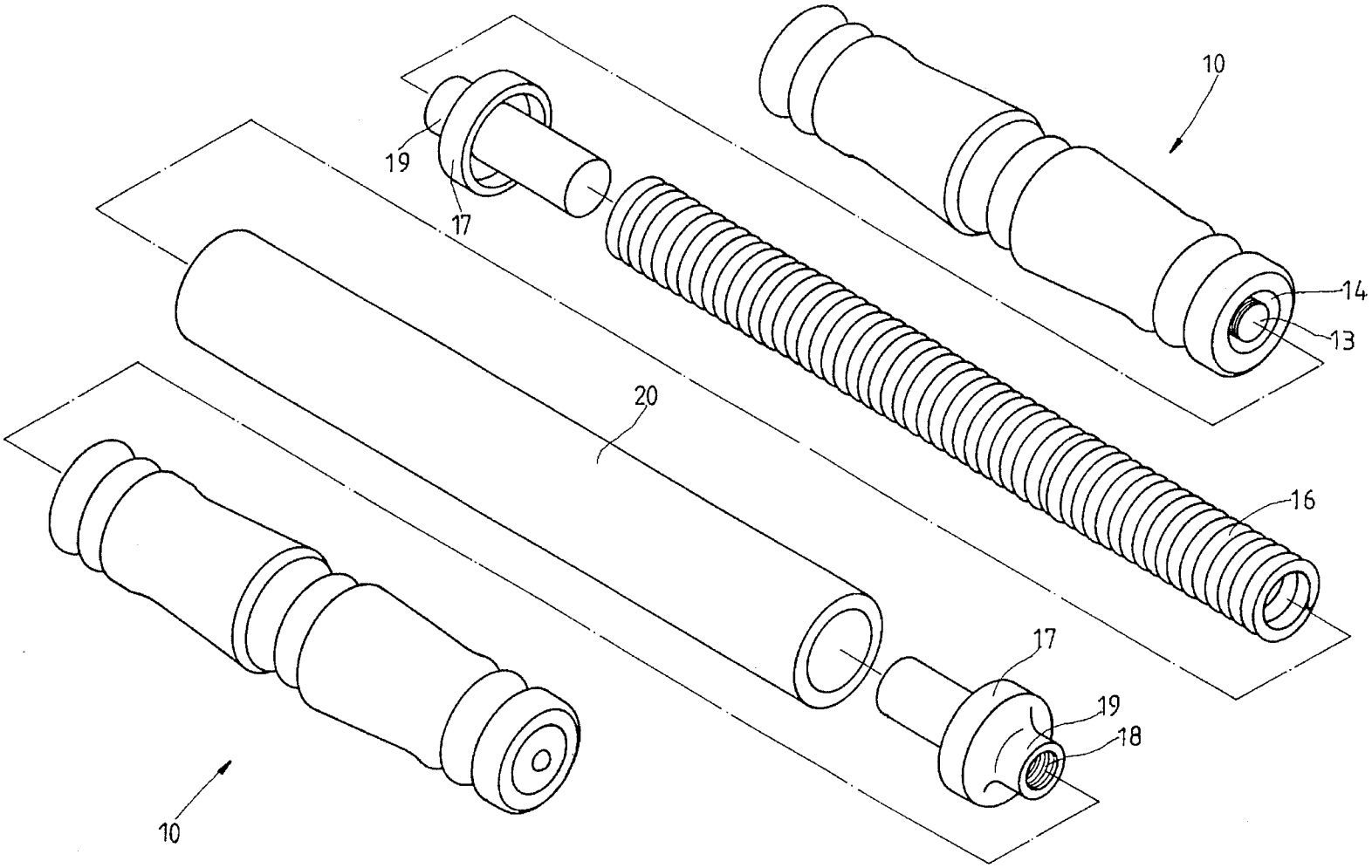
FIG. 3 shows an exploded view of the spring and the dumb bell of the exercise device of the present invention.
Figure 4:
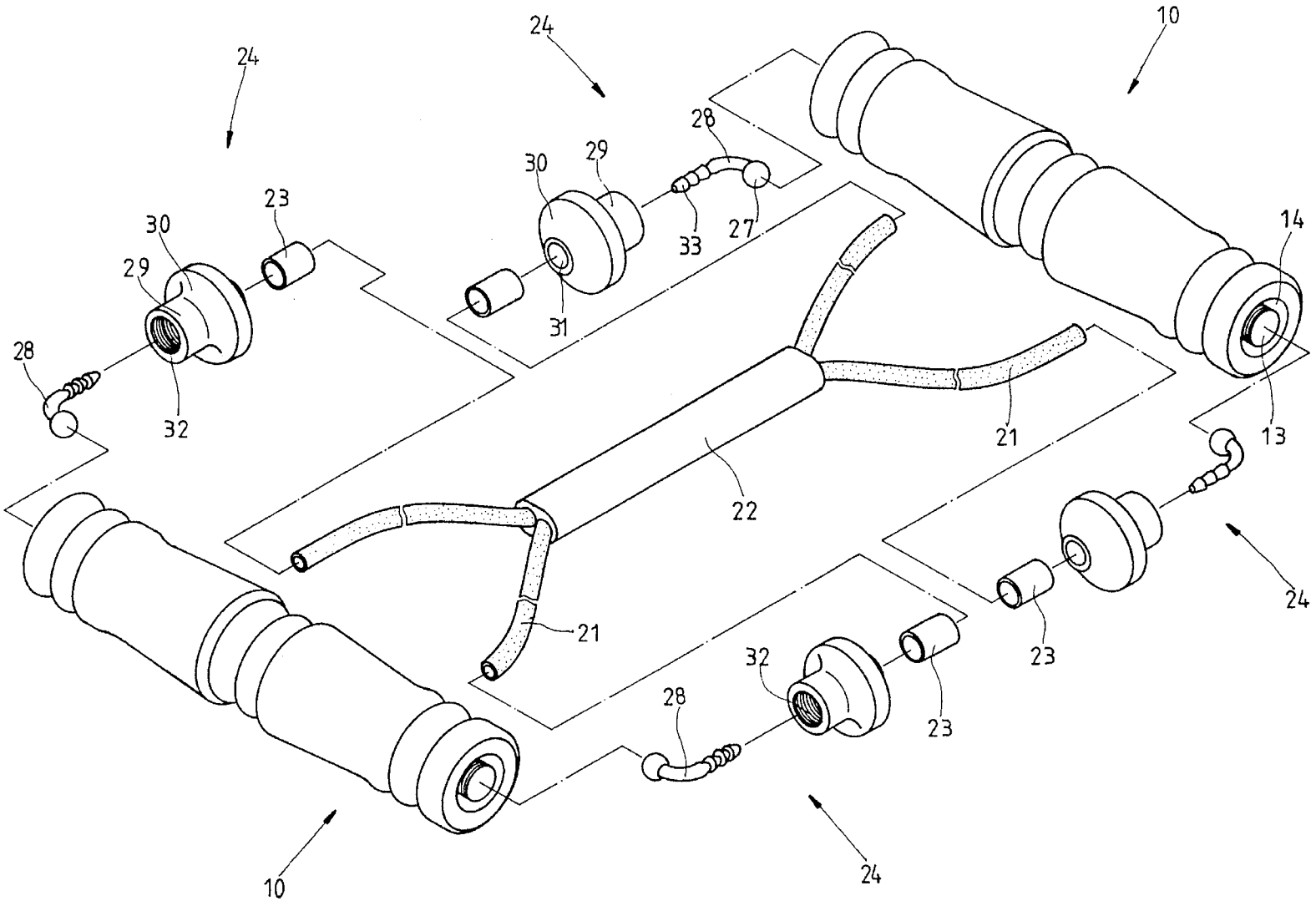
FIG. 4 shows an exploded view of the resilient tube and the dumb bell set of the exercise device of the present invention.
Figure 5:
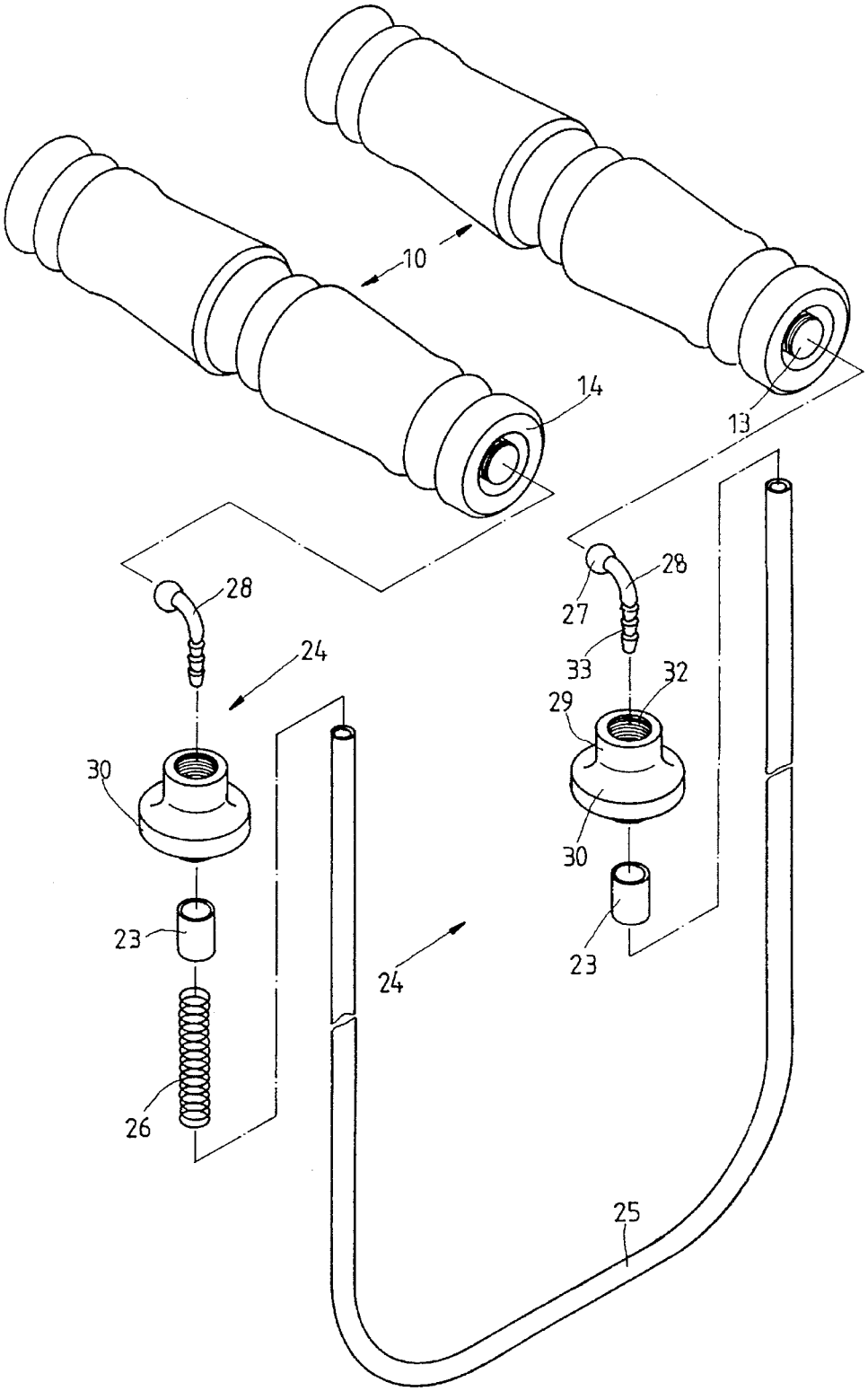
FIG. 5 shows an exploded view of the jump rope tube and the dumb bell set of the present invention.

As shown in FIGS. 1–5, the multipurpose exercise device of the present invention comprises the component parts which are described explicitly hereinafter.

A dumb bell set 10 comprises two dumb bells which are covered respectively with a decorative pad 11 of a soft material. The dumb bells are mounted on a rod 12 of a metal material. The rod 12 is provided respectively at both ends thereof with a threaded portion 13 which is fitted into an end cap 15.

A spring 16 is fastened respectively at both ends thereof with a decorative member 17. The decorative member 17 is provided at one end thereof with a tubular projection 19 of a hollow construction. The tubular projection 19 is provided axially with a threaded hole 18. The spring 16 is fitted into a soft tube 20.

Two resilient tubes 21 are detained respectively at the midsegment thereof by a detaining tube 22. Each of two resilient tubes 21 is provided respectively at both ends thereof with a short tube 23 engageable with a pivoting apparatus 24.

Figure 6:
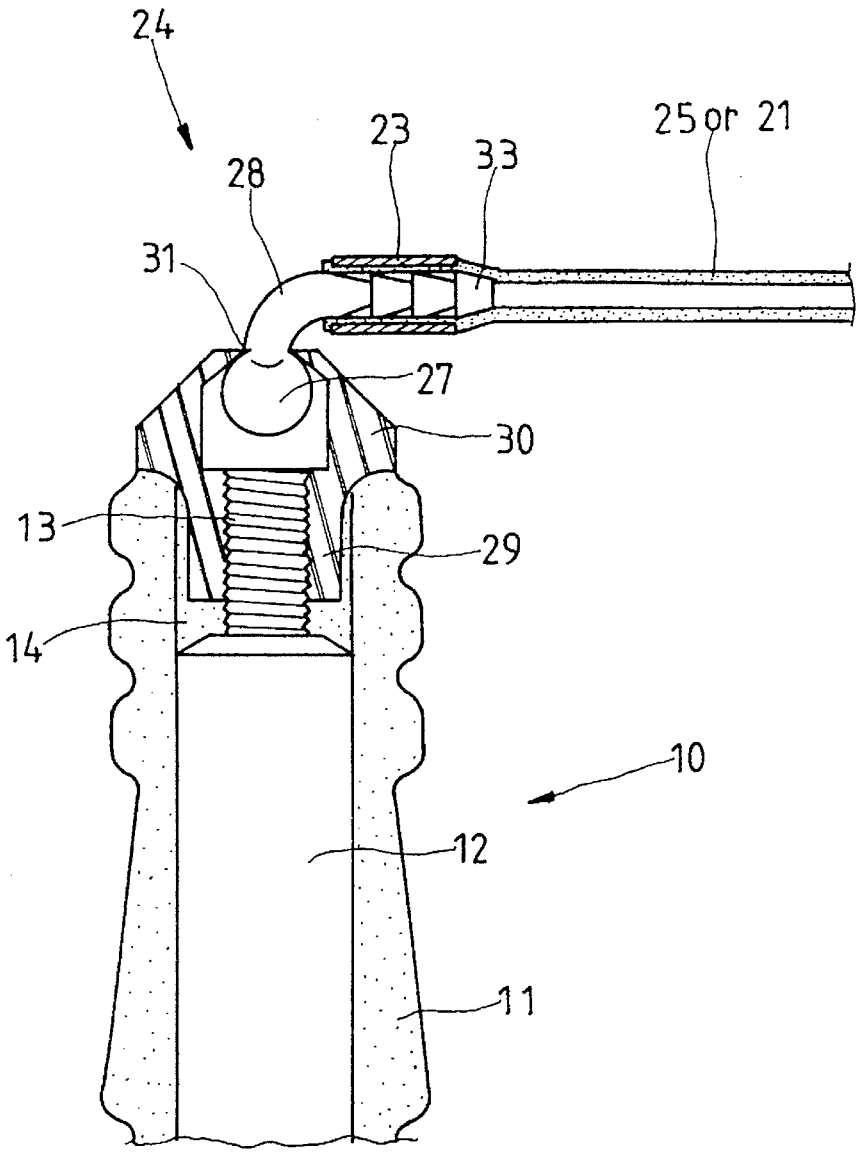
FIG. 6 shows a sectional view of the resilient pivoting apparatus in combination according to the present invention.

The pivoting apparatus 24 is composed of a movable curved rod 28 and a fastening member 30. The movable curved rod 28 has a pivoting point 27 while the fastening member 30 has a tubular projection 29 of a hollow construction. The tubular projection 29 is provided axially with a threaded hole 32 engageable with the threaded portion 13 of the metal rod 12 of the dumb bell set 10. The fastening member 30 is further provided with a through hole 31 which is opposite in location to the threaded hole 32 of the tubular projection 29 such that the through hole 31 is in communication with the threaded hole 32. The movable curved rod 28 is fitted into the through hole 31 such that the movable curved rod 28 is retained by means of the pivoting point 27, and that the connection end 33 of the movable curved rod 28 is engaged with one end of the resilient tube 21 and a jump rope 25, as illustrated in FIG. 6.

Figure 9:
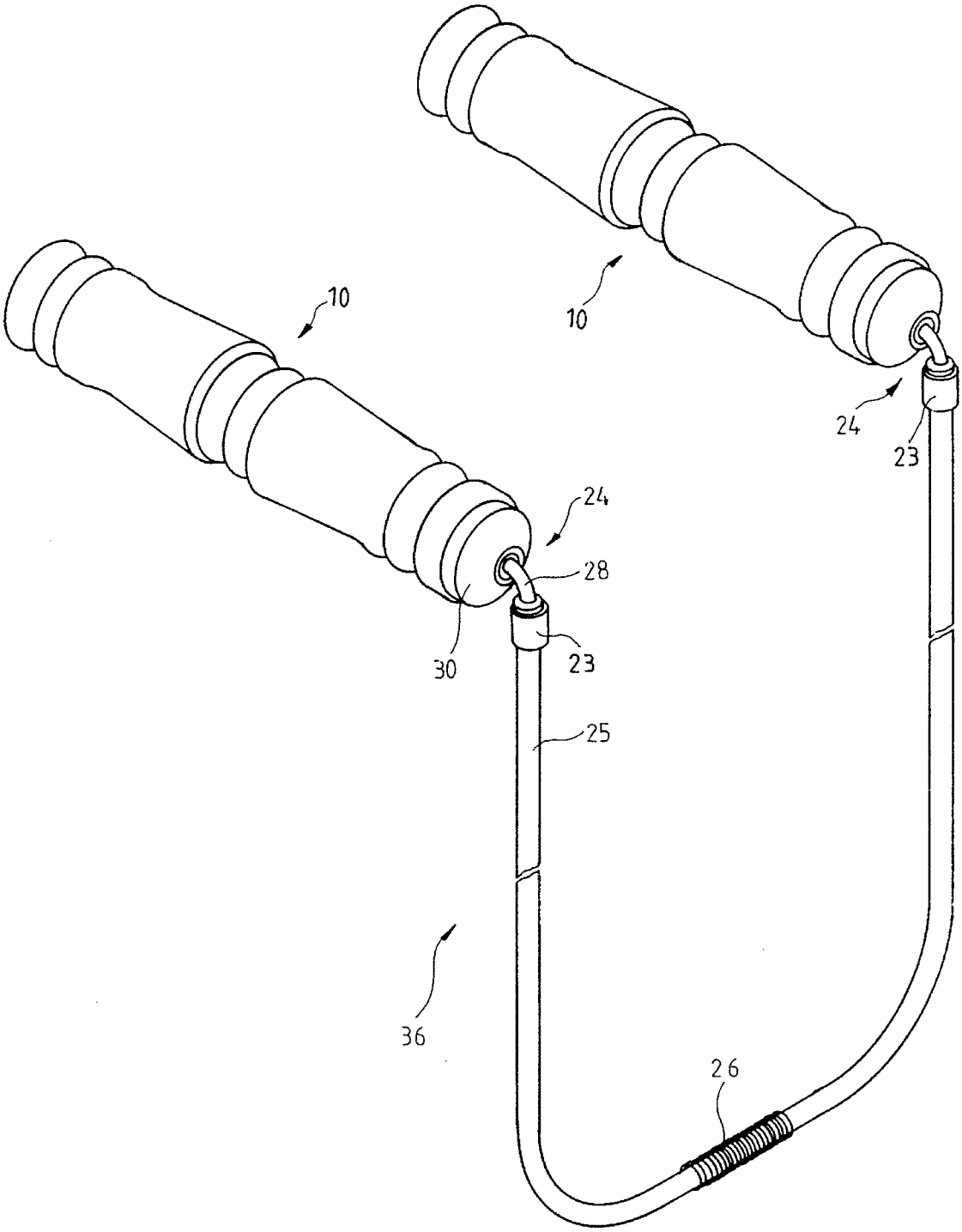
FIG. 9 shows a perspective view of the jump rope of the present invention.

The jump rope 25 is provided at the midsegment thereof with a protective spring 26, as shown if FIG. 9. The jump rope 25 is further provided respectively at both ends thereof with the short tube 23 engageable with the pivoting apparatus 24.

Figure 7:
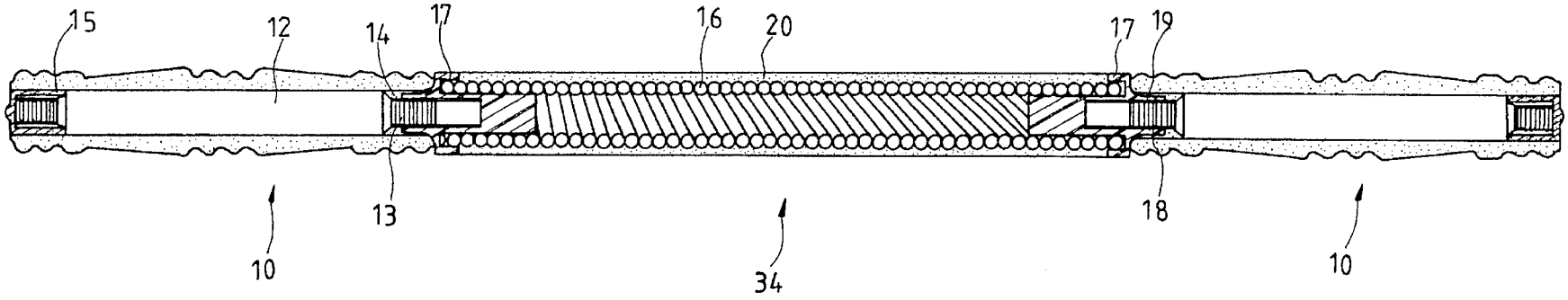
FIG. 7 shows a sectional view of the arm building device in combination according to the present invention.

As shown in FIG. 7, the device of the present invention can be used as an arm building device by fastening the threaded portion 13 of the dumb bell set 10 with the threaded hole 18 of the spring 16 and by fitting the tubular projection 19 of the spring 16 into a ring space 14 formed between the threaded portion 13 and the decorative pad 11.

Figure 8:
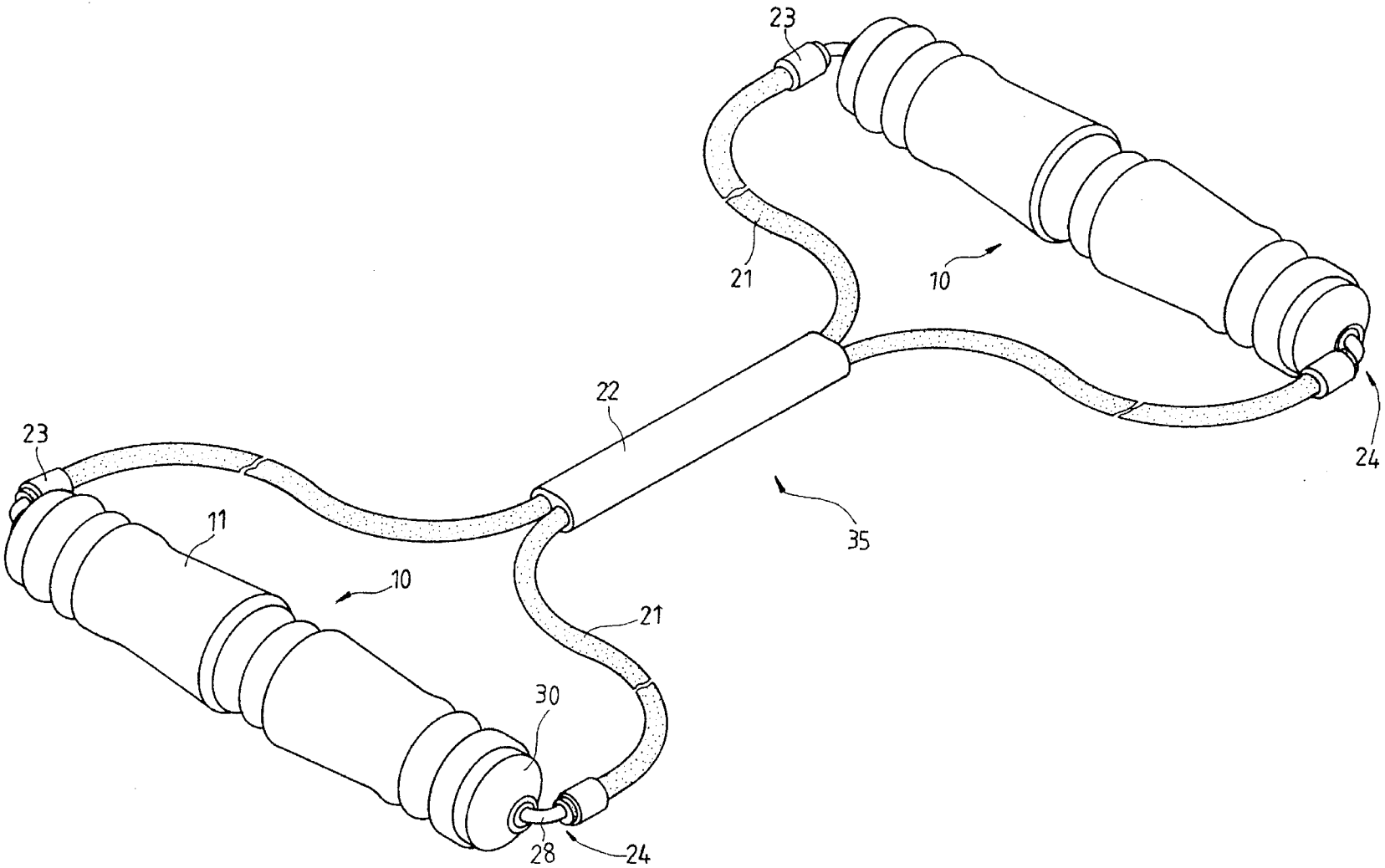
FIG. 8 shows a perspective view of the chest building device of the present invention.

As shown in FIG. 8, the device of the present invention can be used as a chest building device by engaging each threaded hole 32 of the pivoting apparatus 24 with the threaded portion 13 of the dumb bell set 10 such that the tubular projection 29 of the fastening member 30 of the pivoting apparatus 24 is received in the ring space 14.

As shown in FIG. 9, the device of the present invention can be used as a jump rope by engaging the threaded hole 32 of the fastening member 30 of the pivoting apparatus with the threaded portion 13 of the dumb bell set 10 such that the tubular projection 29 of the fastening member 30 is received in the ring space 14.

The embodiment of the present invention described above is to be regarded in all respects as being merely illustrative and not restrictive. Accordingly, the present invention may be embodied in other specific forms without deviating from the spirit thereof. The present invention is therefore to be limited only be the scope of the following appended claim.

What is claimed is:

1. A multipurpose exercise device comprising:

a dumb bell set comprising two dumb bells mounted on a support rod, said support rod provided respectively at both ends thereof with a threaded portion and a decorative pad, said decorative pad being engaged with said threaded portion such that a ring space is formed between said threaded portion and said decorative pad;

a spring provided respectively at both ends thereof with a decorative member having a tubular projection provided therein with a threaded hole, said spring further provided with a protective tube fitted thereover;

two resilient tubes detained at midsegments thereof by a detaining tube and provided respectively at both ends thereof with a fastening apparatus;

a plurality of pivoting apparatuses, each of said pivoting apparatuses comprising a movable curved rod and a fastening member, said movable curved rod provided with a pivoting point, said fastening member provided with a tubular projection having a threaded hole engageable with said threaded portion of said support rod of said dumb bell set, said fastening member further provided with a through hole opposite in location to and in communication with said threaded hole of said tubular projection, said movable curved rod fitted into said through hole such that a connection end of said movable curved rod is engaged with one of said resilient tube; and a jump rope provided at a midsegment thereof with a protective spring, said jump rope further provided respectively at both ends thereof with a fastening apparatus engageable with said connection end of said movable curved rod of said pivoting apparatus;

wherein said threaded portions of said dumb bell set are engaged with said threaded holes of said spring and said tubular projection of said spring is fitted into said ring space of said dumb bell set so as to enable said multipurpose exercise device to be used as an arm building device;

wherein said multipurpose exercise device can be converted into a chest building device by engaging said threaded holes of said pivoting apparatus with said threaded portions of said dumb bell set such that said tubular projection of said fastening member of said pivoting apparatus is received in said ring space of said dumb bell set;

whereing said multipurpose exercise device can be converted into a jump rope by engaging said threaded hole of said fastening member of said pivoting apparatus with said threaded portion of said dumb bell set such that said tubular projection of said fastening member of said pivoting apparatus is received in said ring space of said dumb bell set.

* * * * *